US007104550B2

(12) United States Patent
Pascal

(10) Patent No.: US 7,104,550 B2
(45) Date of Patent: Sep. 12, 2006

(54) SNOWBOARD BINDING

(75) Inventor: Jean-Marc Pascal, Voreppe (FR)

(73) Assignee: Skis Rossignol S.A., Voiron (FR)

( * ) Notice: Subject to any disclaimer, the term of this patent is extended or adjusted under 35 U.S.C. 154(b) by 58 days.

(21) Appl. No.: 10/911,491

(22) Filed: Aug. 5, 2004

(65) Prior Publication Data

US 2005/0051677 A1 Mar. 10, 2005

(30) Foreign Application Priority Data

Sep. 8, 2003 (FR) ..... 03 50507

(51) Int. Cl.
*B62B 9/04* (2006.01)

(52) U.S. Cl. ..... 280/14.24; 280/611; 280/617; 280/618; 280/14.22

(58) Field of Classification Search ..... 280/14.24, 280/611, 617, 618, 11.36, 11.33, 14.22
See application file for complete search history.

(56) References Cited

U.S. PATENT DOCUMENTS 5,261,689 A * 11/1993 Carpenter et al. ..... 280/618
5,667,237 A * 9/1997 Lauer ..... 280/607
5,984,325 A * 11/1999 Acuna ..... 280/14.24
6,203,051 B1 * 3/2001 Sabol ..... 280/607
6,283,482 B1 * 9/2001 Coulter ..... 280/14.22
6,364,323 B1 4/2002 Coulter
6,511,091 B1 1/2003 Su et al.
6,554,297 B1 * 4/2003 Phillips et al. ..... 280/14.22
6,578,865 B1 * 6/2003 Chaput ..... 280/617
6,726,238 B1 * 4/2004 Poscich ..... 280/624
6,758,488 B1 * 7/2004 Laughlin et al. ..... 280/624
6,976,684 B1 * 12/2005 Carrasca ..... 280/14.22
2004/0227328 A1 * 11/2004 Carrasca ..... 280/618

FOREIGN PATENT DOCUMENTS

EP 1 142 615 A2 10/2001

* cited by examiner

*Primary Examiner*—J. Allen Shriver
(74) *Attorney, Agent, or Firm*—Browdy and Neimark, PLLC

(57) ABSTRACT

A snowboard binding (1) that includes a part (10) that can move relative to a fixed part (2) and a manually actuated mechanism (20) for adjusting the position of and immobilizing the moveable part (10) relative to the fixed part (2), wherein said mechanism includes an operating lever (30), that is integral with the fixed part (2), and a retractable locking piece (25) that is capable of moving through the effect of the movement of the lever (30), between a position in which it is caught in a housing (15) chosen from a plurality of housings produced in the moveable part (10), and a position in which it is retracted, thus allowing the moveable part (10) to move relative to the fixed part (2).

13 Claims, 3 Drawing Sheets

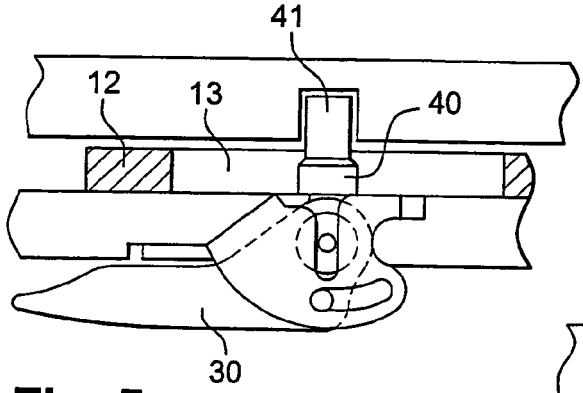
Fig. 5
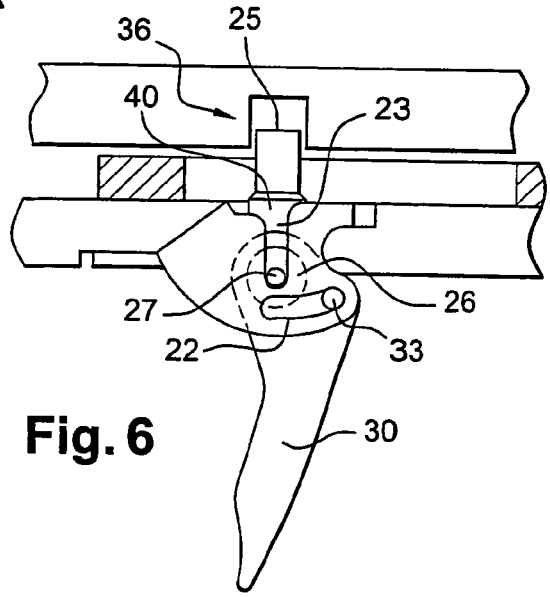
Fig. 6
Fig. 7
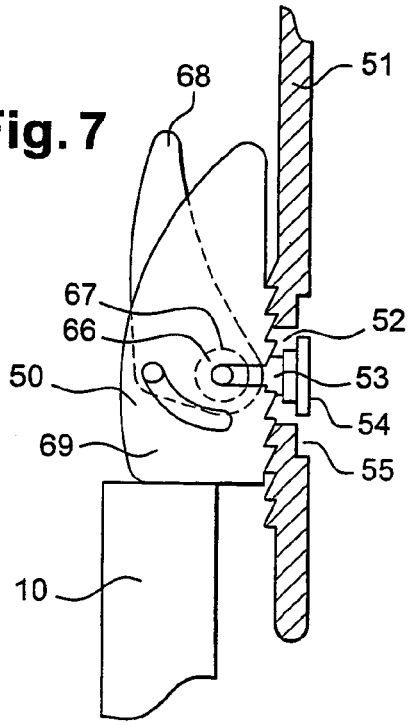
Fig. 8
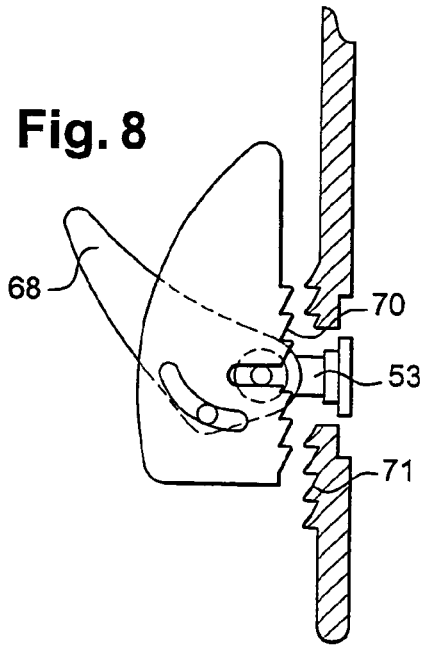

SNOWBOARD BINDING

TECHNICAL FIELD

The invention relates to the field of gliding sports and, more particularly, to that of snowboarding. It refers more particularly to special arrangements for a snowboard binding. These arrangements allow easily modifiable adjustment, by the user, of the position of the heel loop and/or of the spoiler relative to the base plate.

PRIOR ART

Generally, a snowboard binding comprises a base plate to be secured to the upper face of the gliding board. This base plate frequently receives a rear heel loop, which supports a spoiler configured in order to receive the rear bearing forces exerted by the user. Sometimes, the spoiler is directly articulated on the base plate itself.

It has already been proposed, and particularly in documents U.S. Pat. No. 6,364,323, U.S. Pat. No. 6,283,482 and EP 1 142 615, to make certain parts of the binding, particularly the heel loop, adjustable relative to the base plate. In fact, such adjustment makes it possible to adapt the binding to different boot sizes, which is particularly appreciated in the case of rental equipment or when the user changes boots. Similarly, the position of the spoiler may be adjusted in order to adapt to the user's riding style. Thus, the angle of tilt of the spoiler may be adjusted more or less toward the front by means of the displacement of a stop that interacts with the heel loop. Similarly, the position of the spoiler relative to the heel loop may be modified by means of a rotation around the leg, so as to allow take-up of the bearing forces more on the inner side of the leg.

Thus, there is felt to be a need to allow adjustment of the longitudinal position of the heel loop or of the position—either in terms of tilt or in terms of rotation—of the spoiler relative to the heel loop, or even of the longitudinal position of the spoiler relative to the base plate.

In the aforementioned documents, this adjustment is effected by means of a manually actuated mechanism that includes an operating lever associated with a cam or eccentric system. Thus, depending on the position of the operating lever, an effort is exerted in order to press or not to press a zone of the moveable part on the zone opposite the fixed part and, typically, of the heel loop on the base plate or of the stop relative to the spoiler.

It will be appreciated that this type of mechanism that functions with eccentric systems is limited as the maintenance of the fixed part in position relative to the moveable part is due solely to the effort exerted in the zone forming the cam of the lever. The mechanical stresses are thus essentially concentrated at this point with, inevitably, limitation of the holding effort, in order to avoid breakage of the mechanism at the axis of rotation.

A problem that the invention proposes to solve is therefore that of increasing the secure nature of the immobilization of the moveable parts relative to the fixed parts and to do so while allowing manual operation without the need for tools.

SUMMARY OF THE INVENTION

The invention thus relates to a snowboard binding that includes two parts that can move relative to one another and, typically, the heel loop relative to the base plate, or the spoiler relative to the heel loop, or even the tilt stop relative to the spoiler.

In a known manner, this binding includes a manually actuated mechanism for adjusting the position of and immobilizing the two parts relative to one another.

In accordance with the invention, this mechanism includes an operating lever, articulated relative to a flat, and an element that is articulated relative to the lever and that is capable of moving through the effect of the movement of the locking lever. This element can thus move in order to allow or to deny the movement of the parts relative to one another.

In other words, the invention consists in producing an immobilizing mechanism, one element of which forms a locking piece that penetrates inside one of the parts of the binding, for example the heel loop, such that it is impossible for this moveable part to move relative to the other, fixed part, namely the base plate, even with a very great deal of effort.

This locking piece may then be extracted from the moveable part with a movement that is thus perpendicular to the displacement movement then allowed between the moveable parts relative to one another. This locking piece can then be displaced again so as to interact with a housing or, more generally, a zone ensuring its catching relative to the moveable part.

In practice, the element that is articulated relative to the lever is guided in its translational movement in the flat by means of a first guide aperture made in the flat. This first aperture is thus parallel to the movement of displacement of the locking piece and thus perpendicular to the surface of the moveable part in which the locking piece penetrates.

Complementarily, the flat includes a second guide aperture that guides the operating lever in rotation.

In practice, a plurality of embodiments may be implemented depending on whether the piece providing locking is the articulated element pivoting relative to the lever, or the flat.

Thus, in the first embodiment, the locking piece is capable of moving between a position in which it is retracted and a position in which it is caught in a housing chosen from a plurality of housings. These housings are produced in that part of the binding that is moveable relative to that to which the flat is secured.

This operating lever includes a zone receiving a piece guided in translation that is extended by the locking piece. The relative geometry of the two guide apertures of the flat thus gives rise to the displacement of the locking piece during rotation of the operating lever.

In practice, the locking piece may have different geometries. Thus, in a first embodiment, this locking piece may be formed by a stud having, preferably, a cross section of cylindrical general shape.

Thus, in this case, the housings made in the moveable part may advantageously partially overlap and be in communication. In this case, the stud can thus advantageously include two distinct sections, namely a first section with a shape complementing the housing and a second section of smaller dimensions allowing transverse passage toward an adjacent housing.

In other words, the displacement of the stud retracts the wider portion of the stud while leaving the smaller section of the stud caught, said smaller section being able to pass from one housing to the other by means of simple translation.

In another embodiment, the locking piece may be equipped with teeth for engaging with complementary housings located on the moveable part. In this way, as the number of teeth on the moveable part is greater, the locking piece is able to occupy several distinct positions each corresponding to an adjustment position of the moveable part.

The immobilizing mechanism may be designed such that the stud is screwed into a piece that is, on the one hand, guided in translation in the first aperture of the flat and, on the other hand, mounted in rotation relative to the operating lever.

In this way, it is possible to mount the stud after the flat and the operating lever have been mounted, via the face opposite that of the lever. This screwing capability also makes it possible to adjust the play taken up by the stud during manipulation.

In this case, the end of the stud may include an impression for screwing this stud with the aid of a tool during mounting or maintenance.

In the second embodiment, in which the locking piece is formed by all or part of the flat, the latter may have a face coming opposite one of the parts of the binding, with which it interacts in order to immobilize the two parts of the binding.

In a particular embodiment, this face of the flat is equipped with teeth for engaging with complementary housings located on the moveable part of the binding.

In practice, this adjustment system may be arranged in order to allow adjustment of the rear heel loop or of the spoiler relative to the base plate by virtue of one or more operating levers arranged on one side or on either side of the base plate. Similarly, the spoiler and, more particularly, its points of articulation relative to the heel loop, may also be made adjustable by virtue of the invention.

This same mechanism may also be employed to adjust the stop that limits the tilt of the rear spoiler. In this case, this stop is integral with or formed by a part of the flat. This flat is therefore moveable relative to the spoiler, regarded as the fixed part.

BRIEF DESCRIPTION OF THE FIGURES

The way in which the invention is implemented and the advantages arising therefrom will become clearly apparent from the following description of the embodiments, supported by the appended figures, in which:

FIGS. 5 and 6 are sectional views of the immobilizing mechanism shown in an immobilizing and in a retracted position, respectively; and FIGS. 7 and 8 are sectional views of a variant embodiment allowing adjustment of the tilt stop mounted at the rear of a spoiler of the binding.

IMPLEMENTATION OF THE INVENTION

Figure 1:
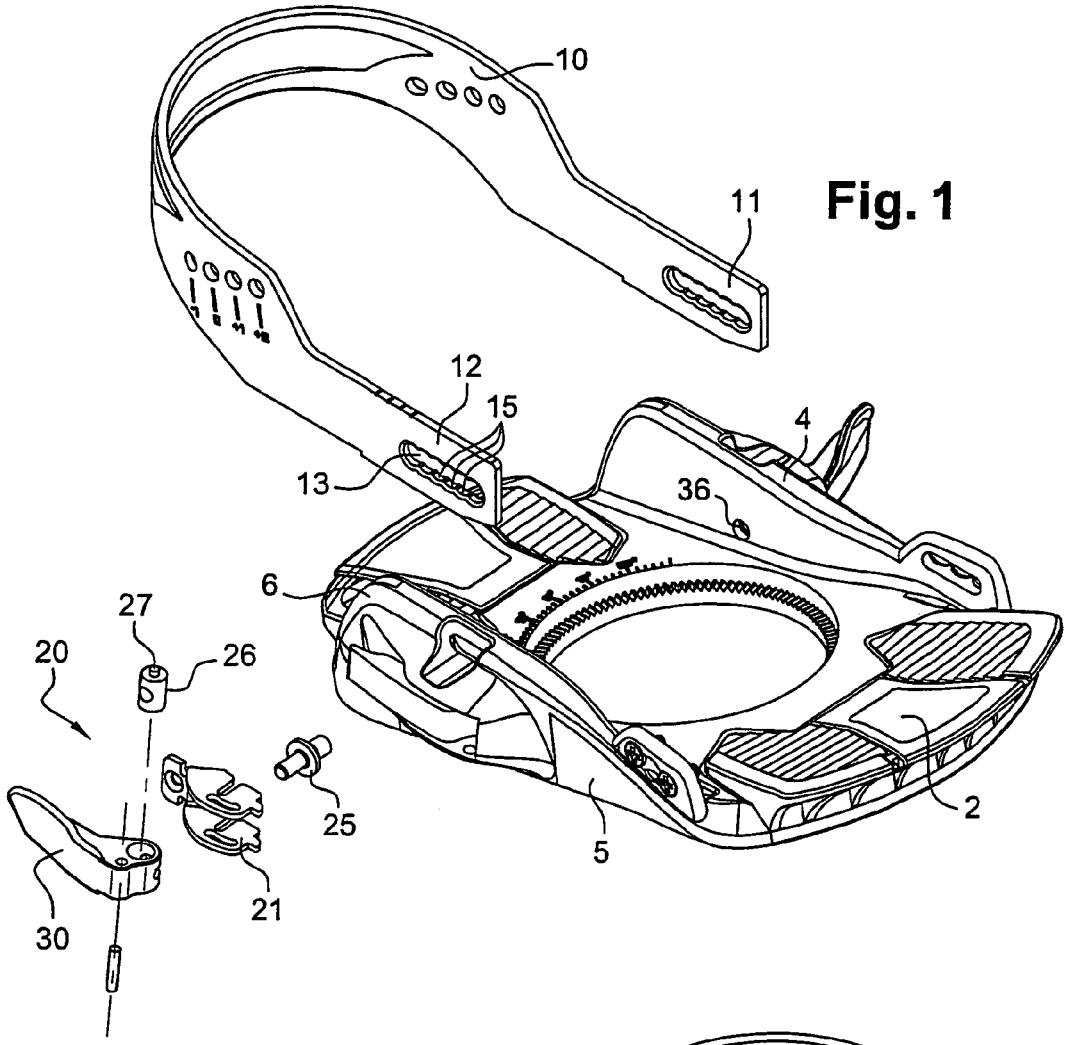
FIG. 1 is an exploded summary perspective view of a binding, the heel loop of which has the capacity to be adjusted longitudinally relative to the base plate.

The binding 1 illustrated in FIG. 1 includes, generally, a base plate 2 for securing to the snowboard, for example by means of a central disc (not shown) interacting with an opening 3 made in the central part of the base plate 2.

This base plate 2 includes two lateral flanks 4, 5 rising on either side of the base plate and each equipped with a slot 6, 7 inside which one of the front ends 11, 12 of the rear heel loop 10 is able to slide.

To adjust the position of this heel loop 10, the ends 11, 12 of the latter are equipped with a longitudinally elongate aperture 13 that includes a plurality of housings 15 of circular general shape.

In the form illustrated in FIG. 1, these housings 15 are of circular general shape and are separated by a distance that is less than their diameter, such that they overlap and communicate partially.

Of course, these housings 15 may also be produced directly inside the aperture 13 formed in the heel loop 10.

The immobilizing mechanism 20, as illustrated in an exploded manner in FIG. 1, essentially includes a flat 21 that is integral with the base plate and includes two guide apertures 22, 23. This flat 21 receives a locking stud 25 that is integral with an intermediate piece 26, of cylindrical general shape, that includes two guide catches 27 on its planar faces 28. These guide catches 27 are capable of sliding in a first guide aperture 23 made in the flat 21.

This intermediate piece 26 is arranged inside a cylindrical housing 31 of complementary shape formed in the operating lever 30. This lever 30 penetrates partially into the flat 21 and is articulated relative to the latter by means of a rotation pin 33 that itself penetrates into a second guide aperture 22 substantially perpendicular to the first guide aperture 23.

Figure 2:
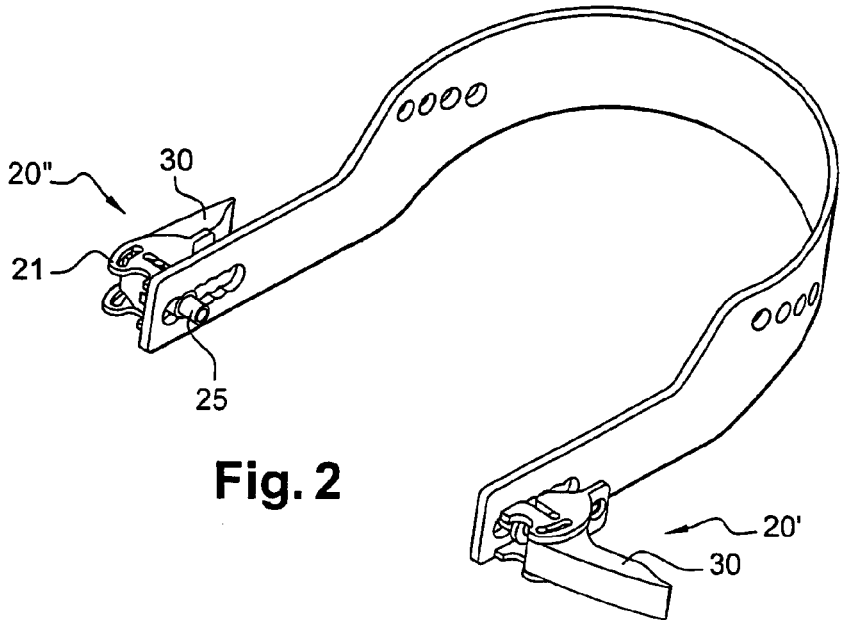
FIG. 2 is a summary perspective view of the heel loop of the binding of FIG. 1, shown independently of the base plate, of which only the immobilizing mechanisms remain.

The assembly of the heel loop 10 and of the two immobilizing mechanisms is illustrated in FIG. 2. The mechanism 20' shown toward the front is in the retracted position, the opposite mechanism 20" being in the immobilized position.

Figure 4:
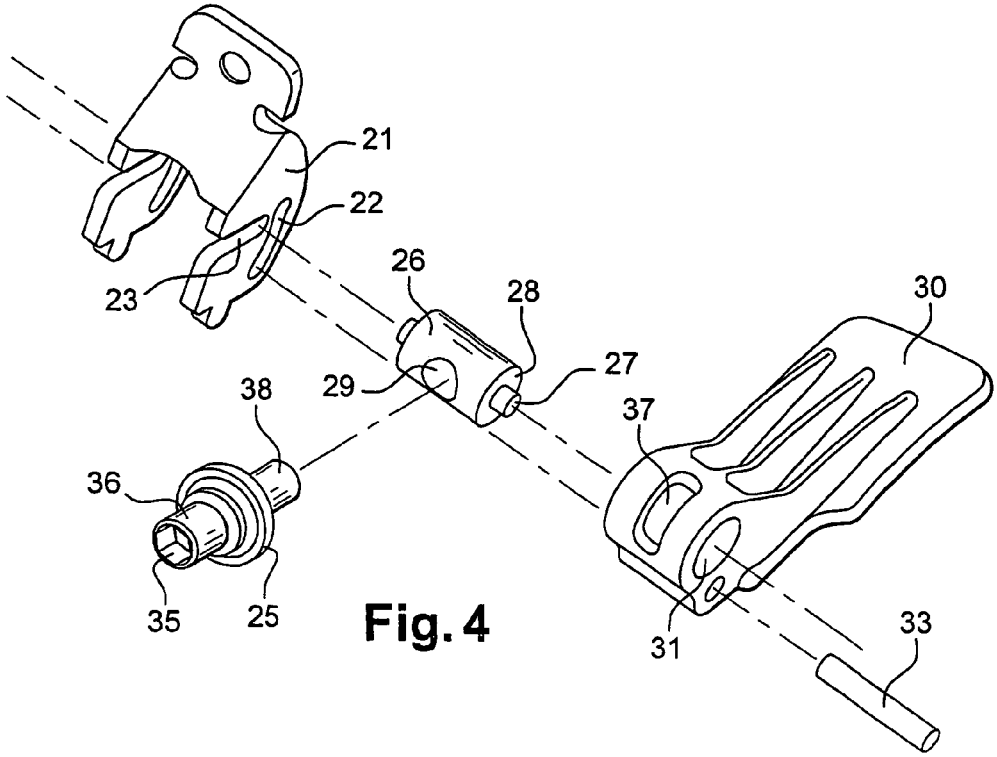
FIG. 4 is an exploded view of the immobilizing mechanism, shown mounted and disassembled.

As illustrated in greater detail in FIG. 4, the stud is screwed into a capped hole 29 made in the intermediate piece 26. This screwing operation may be effected using the impression 35 formed in the end of the stud 25 and that can be seen through the aperture 36 formed in the lateral face 4 of the base plate and illustrated in FIG. 1.

To allow movement of the intermediate piece 26 and thus of the stud 25 relative to the lever 30, the latter includes an opening 37 making it possible to allow passage of the portion 38 of the stud 25 opposite its zone 36 interacting with the housings in the heel loop.

More precisely, and as illustrated in FIGS. 5 and 6, the stud 25 includes, in its portion 36 interacting with the housings, two different cross sections. The first cross section 40 nearer to the lever 30 has a larger diameter that corresponds to the diameter of the housings 15 made in the heel loop 10. The end part 41 of the stud, however, has a slightly smaller diameter that corresponds to the space separating the walls delimiting the housings 15 in the heel loop. In this way, the end portion 41 of the stud 25 may be displaced by passing from one housing to the other when, as illustrated in FIG. 6, the stud 25 is in the retracted position.

This arrangement makes it possible, in particular, to prevent the heel loop 10 from disengaging from the base plate 2 in an unexpected manner without using a stop mechanism that forms an integral part of the form of the heel loop.

Figure 3:
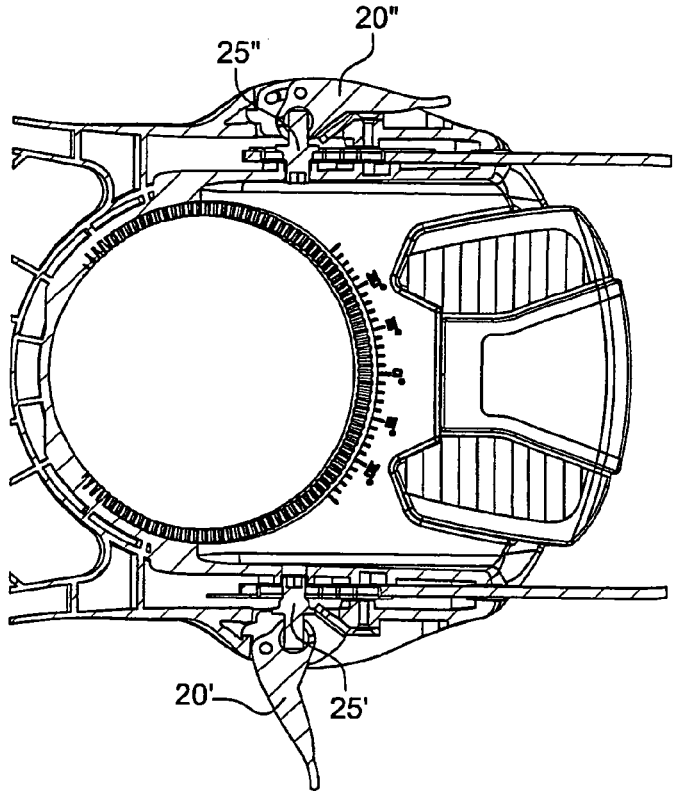
FIG. 3 is a plan view of the binding of FIG. 1, showing the two immobilizing mechanism in different positions.

FIG. 3 illustrates a configuration of the binding during an adjustment operation. Thus, the mechanism 20" shown at the top is in the immobilized position such that the stud 25" is as illustrated in FIG. 5, in its most projecting position, thus penetrating inside the housings in the heel loop 10 via the larger-diameter cross section thereof.

At the time of unlocking, illustrated in the mechanism 20' located in the bottom part of the binding of FIG. 3 and in FIG. 6, the movement of the lever 30 is reflected in a displacement of its rotation pin 33 inside the second guide aperture 22. Concomitantly, the pin 27 of the intermediate piece 26 is thus offset inside the first guide aperture 23 such that the stud 25 is entrained toward the outside of the heel loop. Only the smaller-diameter cross section 41 of the stud 25 remains inside the series of housings 15, thus allowing the displacement of the heel loop 10 relative to the base plate 2.

Of course, other geometries may be adapted in terms of, on the one hands the housings and, on the other hand, the stud, as long as they allow effective immobilization. Thus, the cylindrical shape is, of course, the simplest to produce, but polygonal or other shapes may be adapted.

The locking piece may, furthermore, have other geometries and, in particular, those illustrated in FIGS. 7 and 8, corresponding to a system for adjusting the rear stop 50 of a spoiler 51. Thus, the maximum tilt of the spoiler is limited toward the rear by the stop 50, which comes into contact with the rear end part of the heel loop 10.

The position of this stop 50 in terms of height relative to the spoiler 51 thus makes it possible to vary this limit tilt.

As already stated, the stop 50 is regarded as the moveable part of the adjustment mechanism of the invention since its position varies on the rear face of the spoiler 51, which is regarded as being fixed.

Thus, as illustrated in FIG. 7, the spoiler 51 includes a vertically elongate aperture 52 by virtue of which the spoiler 51 can be displaced vertically relative to the fixed point that the stop 50 constitutes. More precisely, this spoiler 51 is displaced about a horizontal pin 53 that ends in a nut 54 housed in a peripheral recess 55 of the aperture 52. This pin 53 is associated with an intermediate piece 66 similar to the intermediate piece 26 of FIG. 4 and also able to slide inside a housing 67 provided inside the lever 68.

The flat 69, inside which the lever 68 can be displaced in rotation, is equipped on its face opposite the spoiler with a set of teeth 70 that complement the set of teeth 71 formed on the outer face of the spoiler. In this way, when the control lever 68 is in the position illustrated in FIG. 7, the nut 54 is in its position that is closest to the toothed face 70 of the flat 69 and thus presses the complementary set of teeth of the spoiler 71 on the stop 50.

The position of the stop is thus fixed and incapable of varying in any situation.

Conversely, when the control lever 68 is displaced as illustrated in FIG. 8, the pin 53 and thus the nut 54 are pushed back relative to the flat 69 carrying the set of teeth. The rear face of the spoiler supporting the complementary set of teeth 71 is thus spaced apart from the flat forming the stop 69. The spoiler 51 is thus capable of being displaced vertically about the pin 53 in order to adopt the desired maximum tilt. In practice, it is possible to combine locking by the employment of studs and housings and also complementary sets of teeth.

Of course, the invention is not limited merely to the examples described in detail, but covers immobilizing mechanisms that may equip all parts of the binding that have a position that can be adjusted relative to another part of the binding.

It is apparent from the aforesaid that the binding in accordance with the invention has multiple advantages, in particular:

that of guaranteeing firm, effective immobilization, owing to the significant interpenetration of the portion integral with the fixed part inside the housing in the moveable part; and that of allowing easy manipulation without the need for a tool, thus making a particularly rapid adjustment possible.

The invention claimed is:

1. A snowboard binding (1) that includes two parts (2, 10) that can move relative to one another and a manually actuated mechanism (20) for adjusting the position of and immobilizing the two parts (2, 10) relative to one another, wherein said mechanism includes an operating lever (30), articulated relative to a flat (21), and an element (25) articulated relative to the lever (30) and capable of moving relative to the flat (21) through the effect of the movement of the lever in order to allow or to deny the movement of the parts (2, 10) relative to one another, wherein the element (25) that is articulated relative to the lever is guided in its translational movement in the flat (21) by a first guide aperture (23) made in said flat (21), and wherein the flat (21) includes a second guide aperture (22) guiding the operating lever (30) in rotation.

2. The binding as claimed in claim 1, wherein the element (25) that is articulated relative to the lever forms a locking piece interacting with one of the two parts (2, 10) of the binding.

3. The snowboard binding as claimed in claim 2, wherein the locking piece is a stud.

4. The snowboard binding as claimed in claim 1, wherein the flat (50) forms the locking piece and has a face that comes opposite one of the parts of the binding with which it interacts, in order to lock the two parts of the binding.

5. The snowboard binding as claimed in claim 4, wherein the face of the flat (69) is equipped with teeth (70) for engaging with complementary housings (71) located on the moveable part (51).

6. The snowboard binding as claimed in claim 1, which includes a rear heel loop that is moveable and adjustable in terms of position relative to a base plate and receives one or more operating levers.

7. The snowboard binding as claimed in claim 1, which includes, at the rear, a spoiler that is articulated relative to a rear heel loop, said spoiler being adjustable in terms of position relative to the heel loop with the aid of an operating lever.

8. The snowboard binding as claimed in claim 3, wherein said stud has a cylindrical cross section.

9. A snowboard binding (1) that includes two parts (2, 10) that can move relative to one another and a manually actuated mechanism (20) for adjusting the position of and immobilizing the two parts (2, 10) relative to one another, wherein said mechanism includes an operating lever (30), articulated relative to a flat (21), and an element (25) articulated relative to the lever (30) and capable of moving relative to the flat (21) through the effect of the movement of the lever in order to allow or to deny the movement of the parts (2, 10) relative to one another, wherein the element (25) that is articulated relative to the lever forms a locking piece interacting with one of the two parts (2, 10) of the binding, and wherein the locking piece is capable of moving between:

a position in which it is caught in a housing (15) chosen from a plurality of housings made in the part (10) of the binding that is moveable relative to the part (2) of the binding to which the flat (21) is secured; and a position in which it is retracted, allowing the relative displacement of said parts (2, 10) of the binding.

10. The snowboard binding as claimed in claim 9, wherein the housings (15) made in the moveable part partially overlap and are in communication.

11. The snowboard binding as claimed in claim 10, wherein the stud (25) includes two distinct sections, i.e. a first section (40) with a shape complementary to the housings (15) of the moveable part and a second section (41) allowing transverse passage toward an adjacent housing (15).

12. The snowboard binding as claimed in claim 9, wherein the stud (25) is screwed into an intermediate piece (26) guided in translation within the first aperture (23) of the flat (21) and mounted in rotation relative to the operating lever (30).

13. The snowboard binding as claimed in claim 9, wherein one of the ends of the stud (25) includes an impression (35) allowing the stud to be screwed with the aid of a tool.

* * * * *